US008454410B2

(12) United States Patent
Kitagawa et al.

(10) Patent No.: US 8,454,410 B2
(45) Date of Patent: Jun. 4, 2013

(54) POLISHING APPARATUS

(75) Inventors: Koji Kitagawa, Nishishirakawa (JP); Junichi Ueno, Nishishirakawa (JP); Syuichi Kobayashi, Nishishirakawa (JP); Hideo Kudo, Nishishirakawa (JP); Tadakazu Miyashita, Nagano (JP); Atsushi Kajikura, Nagano (JP); Yoshinobu Nishimoto, Nagano (JP)

(73) Assignees: Shin-Etsu Handotai Co., Ltd., Tokyo (JP); Fujikoshi Machinery Corp., Nagano (JP)

( * ) Notice: Subject to any disclaimer, the term of this patent is extended or adjusted under 35 U.S.C. 154(b) by 972 days.

(21) Appl. No.: 12/449,400

(22) PCT Filed: Jan. 29, 2008

(86) PCT No.: PCT/JP2008/000100

§ 371 (c)(1),
(2), (4) Date: Aug. 6, 2009

(87) PCT Pub. No.: WO2008/105137

PCT Pub. Date: Sep. 4, 2008

(65) Prior Publication Data

US 2010/0144249 A1 Jun. 10, 2010

(30) Foreign Application Priority Data

Feb. 27, 2007 (JP) ..... 2007-046760

(51) Int. Cl.
*B24B 29/00* (2006.01)

(52) U.S. Cl.
USPC ..... 451/285; 451/288; 451/262; 451/268; 451/449

(58) Field of Classification Search
USPC ..... 451/41, 285, 286, 287, 288, 262, 451/268, 449
See application file for complete search history.

(56) References Cited

U.S. PATENT DOCUMENTS 5,679,059 A * 10/1997 Nishi et al. ..... 451/41
6,250,997 B1 6/2001 Hatano et al.

(Continued)

FOREIGN PATENT DOCUMENTS

JP A-1-107927 4/1989
JP A-7-237113 9/1995

(Continued)

OTHER PUBLICATIONS

Office Action issued in corresponding Japanese Patent Application No. 2007-046760, issued Oct. 12, 2010. (with partial English-language translation).

(Continued)

*Primary Examiner* — Eileen P. Morgan
(74) *Attorney, Agent, or Firm* — Oliff & Berridge, PLC

(57) ABSTRACT

Provided is a polishing apparatus comprising a lower stool (12), a motor (18*a*) and a speed reducer (19*a*) for driving the lower stool, and a box (17) for covering at least the portion of the lower stool below the working action face. The polishing apparatus polishes a wafer by forcing the wafer to contact the lower stool and by rotating the lower stool. The box has its inside separated by partitions (31*a* and 31*b*) into a plurality of regions, and the motor for driving the lower stool is arranged in a region other than the region containing the lower stool. The polishing apparatus can manufacture a wafer of a stable shape, irrespective of the time elapsed from the running start and the presence/absence of the stop of the polishing apparatus.

11 Claims, 4 Drawing Sheets

U.S. PATENT DOCUMENTS

| | | | | |
|---|---|---|---|---|
| 6,431,948 | B1 * | 8/2002 | Atoh | 451/5 |
| 6,547,660 | B1 | 4/2003 | Suenaga et al. | |
| 6,616,512 | B2 * | 9/2003 | Sotozaki | 451/54 |
| 6,783,427 | B2 * | 8/2004 | Isobe et al. | 451/5 |
| 2004/0266326 | A1 * | 12/2004 | Shiho et al. | 451/526 |

FOREIGN PATENT DOCUMENTS

| | | |
|---|---|---|
| JP | A-11-188613 | 7/1999 |
| JP | A-2000-33556 | 2/2000 |
| JP | A-2000-127033 | 5/2000 |
| JP | A-2000-218515 | 8/2000 |
| JP | A-2002-331430 | 11/2002 |
| TW | 446807 | 7/2001 |

OTHER PUBLICATIONS

Taiwanese Office Action issued in Taiwanese Application No. 097104271 dated Jun. 21, 2012 (w/partial translation).

Taiwanese Search Report issued in Taiwanese Application No. 097104271 dated Jun. 18, 2012 (w/translation).

* cited by examiner

[Fig. 1]
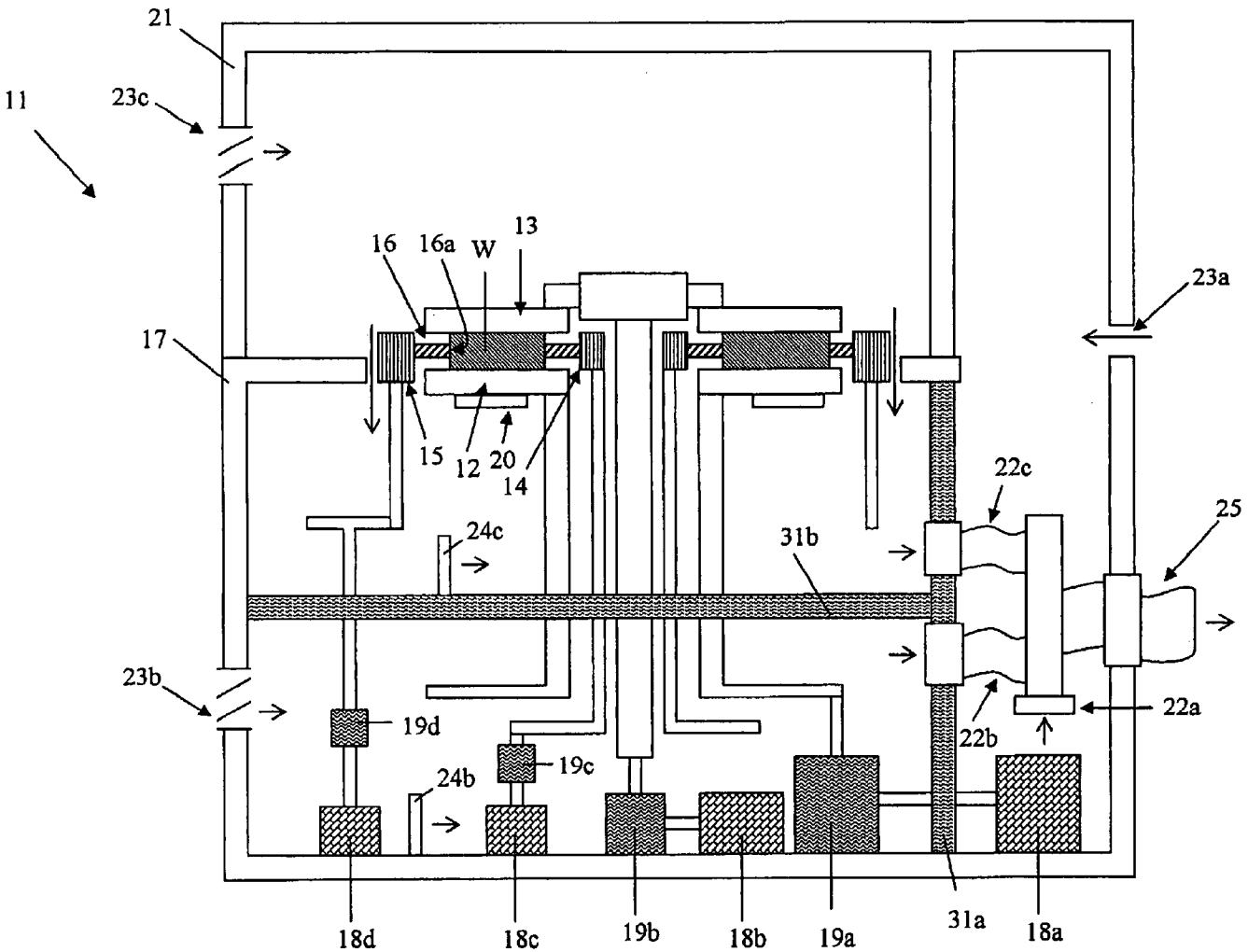

[Fig. 2]
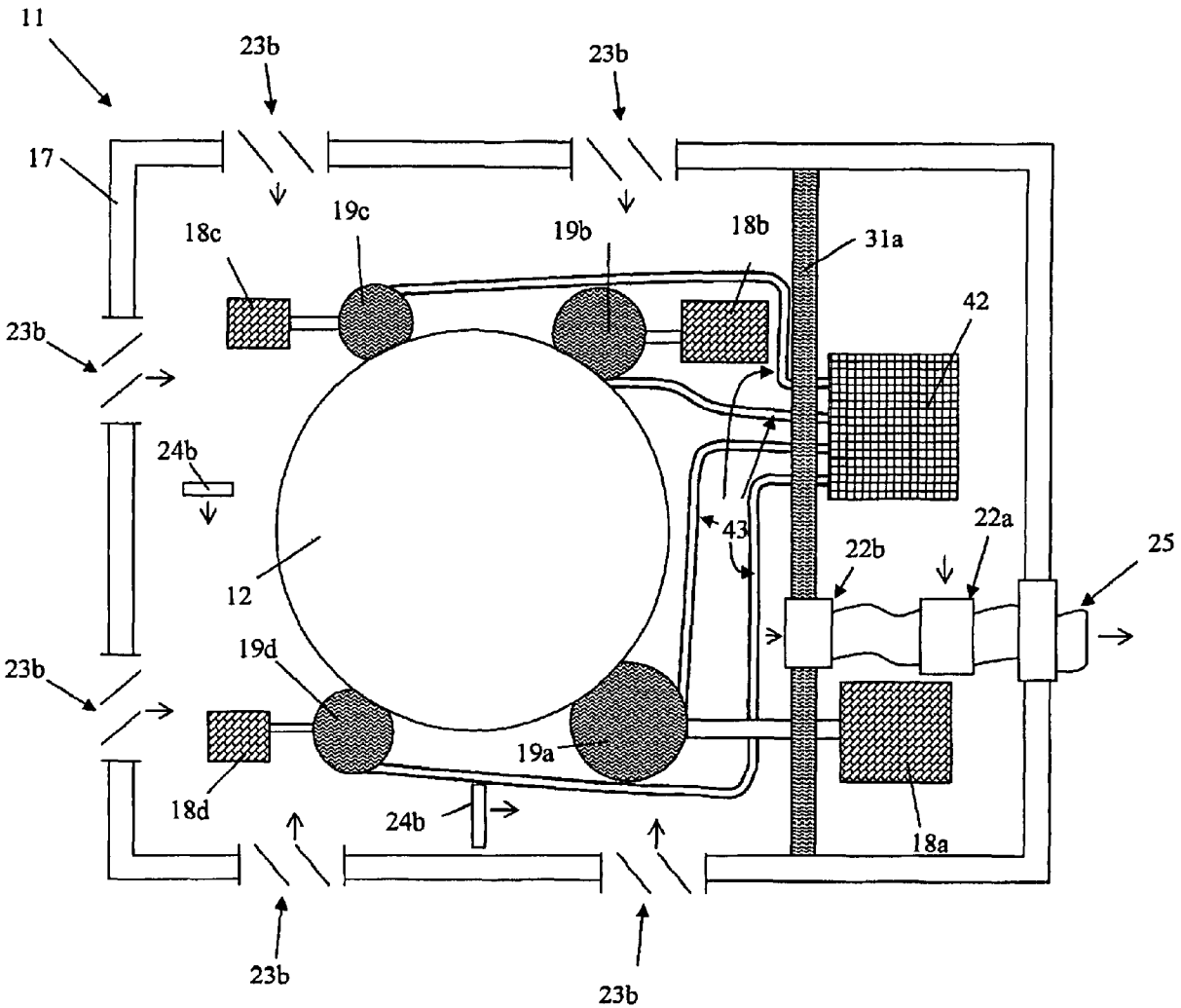

[Fig. 3]
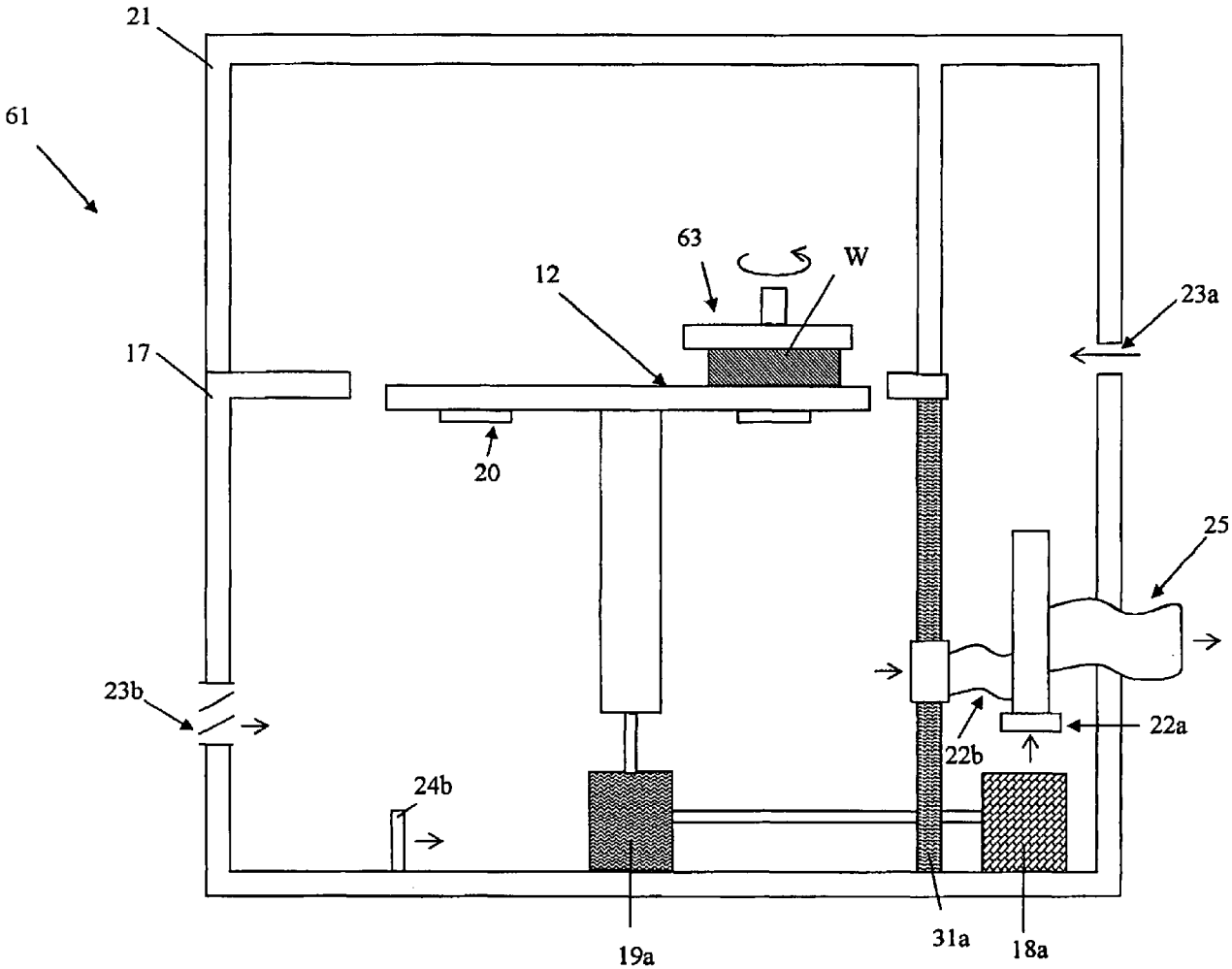

[Fig. 4]
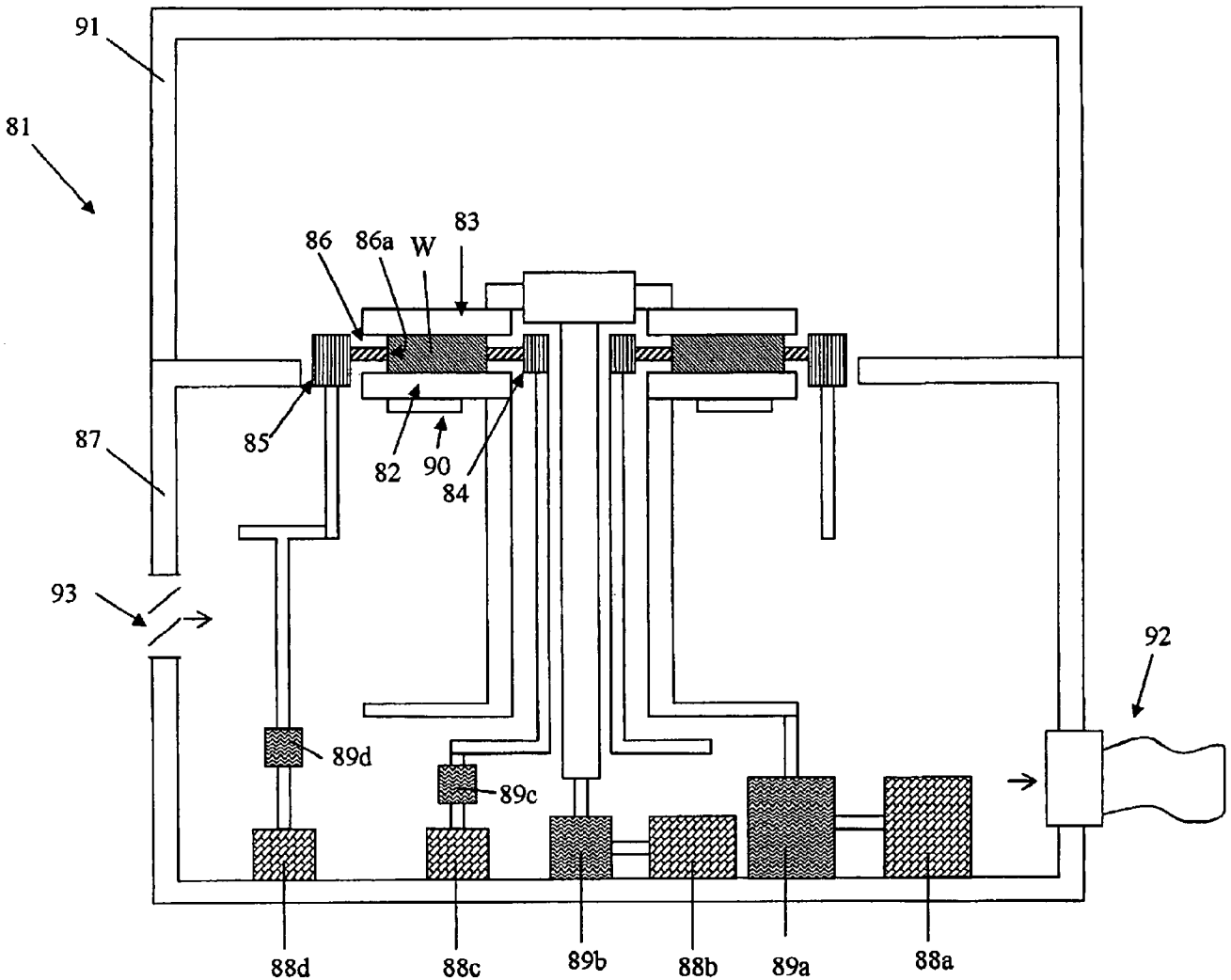

POLISHING APPARATUS

TECHNICAL FIELD

The present invention relates to a polishing apparatus polishing the front surface of a wafer.

BACKGROUND ART

Thin plate-shaped materials such as semiconductor wafers and magnetic disks (hereinafter collectively referred to as wafers) are polished to a predetermined thickness by grinding or lapping processing, and are then mirror-finished by polishing processing.

In surface machining to obtain a surface with a high degree of flatness, the machining in which grinding processing, lapping processing, polishing processing, and the like, are performed, a single-side polishing apparatus which presses a wafer against a lower turn table with a polishing head and performs polishing while supplying polishing slurry or a double-side polishing apparatus which sandwiches a disk-shaped wafer between upper and lower turn tables and polishes both surfaces simultaneously while supplying polishing slurry is used.

FIG. 4 depicts an outline of the structure of an example of a conventional double-side polishing apparatus. A double-side polishing apparatus 81 mainly includes rotatable disk-shaped lower turn table 82 and upper turn table 83, between the upper and lower turn tables 82 and 83, a carrier plate 86 which has a wafer holding hole 86*a* holding a wafer W and performs planetary movement, and a sun gear 84 and an internal gear 85 which move the carrier plate. Moreover, an upper cover 91 covering an upper part of the apparatus is sometimes placed. In a polishing process, the wafer W is held between the upper and lower turn tables 82 and 83 each having a front surface to which a polishing pad is attached, and polishing slurry is supplied to the machining surfaces while rotating the wafer W and the upper and lower turn tables 82 and 83 and applying pressure from the side of the upper turn table 83, whereby the front surface of the wafer is gradually removed by the combined action of a chemical action and a mechanical action of the polishing slurry, and the purpose thereof is to provide an object to be polished with a mirror-finished surface and to flatten it. The above-described lower turn table 82, upper turn table 83, sun gear 84, and internal gear 85 are driven by their respective drive motors 88*a*, 88*b*, 88*c*, and 88*d* and speed reducers 89*a*, 89*b*, 89*c*, and 89*d* placed in an apparatus main body box 87. Although there is an apparatus of the type, which moves them with a single motor, in recent years a four-way type apparatus in which they are driven by their respective motors has often been used. In addition, in the box 87, as a means of circulating the air inside the box, an exhaust duct 92, an outside air intake 93, and the like, are placed.

When a silicon wafer is polished as a wafer W, since the polishing rate of the silicon wafer varies depending on the pressure which the wafer receives from the upper and lower turn tables and the temperature during polishing, in order to machine it to a wafer having a high degree of flatness, it is necessary to keep the shape of the polishing turn table and the temperature of the wafer machining surface constant. Therefore, in a common double-side polishing apparatus, the temperature of the wafer machining surface during polishing is maintained constant by controlling the amount and temperature of polishing slurry supplied to the wafer polishing surface so as to be constant, and additionally thermal deformation of the turn table is prevented by removing heat of polishing generated by machining by supplying cooling water at a constant temperature to a cooling jacket 90 placed in the turn table, whereby the pressure which the wafer receives from the upper and lower turn tables is made constant.

In recent years, the required precision of the flatness of the wafer has become higher. When the required precision of the flatness of the wafer becomes high as described above, the temperature control by the polishing slurry and the removal of heat of polishing generated by machining by supplying cooling water to the cooling jacket are not enough. In particular, during a few batches after the start of machining, degradation of the flatness of the machined wafer is noticeable, and the stability thereof is poor.

Furthermore, since slurry exchange, polishing pad dressing, or the like, consumes downtime of the apparatus on a regular basis even during continuous operation of the polishing apparatus, a change in the shape of the machined wafer is inevitable.

Moreover, as described in Japanese Unexamined Patent Publication (Kokai) No. 11-188613, a double-side polishing apparatus in which an auxiliary heating element is placed on a side of a turn table, the side opposite to the machining surface thereof, and the turn table is heated in advance before the operation of the apparatus and is also heated during operation, whereby the temperature of the turn table is maintained constant has been proposed. However, since it attempts to maintain the temperature of the turn table constant by heating, the flatness of the obtained wafer and the stability thereof are not satisfactory.

DISCLOSURE OF INVENTION

Therefore, the present invention has been made in view of the problems described above, and an object thereof is to provide a polishing apparatus that can produce a wafer having a stable shape regardless of the time that has elapsed since the operation of the polishing apparatus was started or the presence or absence of a stop.

The present invention has been made to solve the problems described above, and provides a polishing apparatus including at least: a lower turn table; a motor and a speed reducer for driving the lower turn table; and a box covering at least a portion below a machining surface of the lower turn table, the polishing apparatus pressing a wafer against the lower turn table and polishing the wafer by rotating the lower turn table, wherein the inside of the box is separated into a plurality of areas by a partition wall, and the motor driving the lower turn table is placed in an area that is different from the area in which the lower turn table is included.

In the polishing apparatus having the structure described above, with the polishing apparatus in which the inside of the box is separated into a plurality of areas by the partition wall, and the motor driving the lower turn table is placed in an area that is different from the area in which the lower turn table is included, it is possible to prevent heat generated from the motor driving the lower turn table from directly affecting the lower turn table, and exhaust heat quickly to the outside of the apparatus, making it possible to prevent effectively a slight distortion in the shape of the lower turn table caused by the influence of heat. This makes it possible to polish the wafer in a stable shape.

In this case, it is preferable that, in the box, the speed reducer driving the lower turn table be placed in an area that is different from the area in which the lower turn table is included.

As described above, when, in the box, the speed reducer driving the lower turn table is placed in an area that is different from the area in which the lower turn table is included, it is also possible to prevent heat generated from the speed reducer for the lower turn table from directly affecting the lower turn table, and exhaust it quickly to the outside of the apparatus, making it possible to prevent a slight distortion of the lower turn table more effectively.

Moreover, it is preferable that the areas in the box, the areas being separated by the partition wall, each include air circulating means.

As described above, when the areas in the box, the areas being separated by the partition wall, each include air circulating means, it is possible to circulate the air in the areas separated by the partition wall on an individual basis, making it possible to exhaust heat generated from a heat-generating source to the outside of the apparatus more efficiently.

Furthermore, it is preferable that the polishing apparatus include cooling fluid supplying means circulating and supplying a cooling fluid to at least the speed reducer driving the lower turn table with a cooling fluid supplying hose and cooling the speed reducer, and the cooling fluid supplying means be placed in an area that is different from the area in which the lower turn table is included.

As described above, when the polishing apparatus includes cooling fluid supplying means circulating and supplying a cooling fluid to at least the speed reducer driving the lower turn table with a cooling fluid supplying hose and cooling the speed reducer, it is possible to remove heat generated from the speed reducer quickly. Moreover, when the cooling fluid supplying means is placed in an area that is different from the area in which the lower turn table is included, it is also possible to exhaust heat generated from the cooling fluid supplying means quickly to the outside of the apparatus without affecting the lower turn table, making it possible to prevent a slight distortion of the lower turn table more effectively.

Moreover, the polishing apparatus includes a polishing head holding the wafer, and the polishing apparatus can be configured such that it presses the wafer against the lower turn table with the polishing head, and polishes the wafer.

Such a single-side polishing apparatus is a single-side polishing apparatus that can polish the wafer while preventing a change in the shape of the lower turn table effectively.

Furthermore, the polishing apparatus further includes an upper turn table, a sun gear, an internal gear, motors and speed reducers, one for each of the upper turn table, the sun gear, and the internal gear for driving the upper turn table, the sun gear, and the internal gear, and a plurality of carrier plates each having a wafer holding hole holding the wafer, and the polishing apparatus can be configured as a double-side polishing apparatus which holds the wafer in the wafer holding hole of the carrier plate, holds the wafer between the lower turn table and the upper turn table, and performs double-side polishing on the wafer by rotating the lower turn table and the upper turn table while making the carrier plate rotate on an axis thereof and revolve around a point by rotating the sun gear and the internal gear.

Such a double-side polishing apparatus is a double-side polishing apparatus that can polish the wafer while preventing a change in the shape of the lower turn table effectively.

In this case, it is preferable that the motors and speed reducers, one for each of the upper turn table, the sun gear, and the internal gear for driving the upper turn table, the sun gear, and the internal gear, be placed in an area that is different from the area in which the lower turn table is included.

As described above, when the motors and speed reducers, one for each of the upper turn table, the sun gear, and the internal gear for driving the upper turn table, the sun gear, and the internal gear, are placed in an area that is different from the area in which the lower turn table is included, it is also possible to prevent heat generated from these motors and speed reducers from affecting the shape of the lower turn table.

Moreover, it is preferable that the polishing apparatus include cooling fluid supplying means circulating and supplying a cooling fluid to the speed reducers, one for each of the lower turn table, the upper turn table, the sun gear, and the internal gear for driving the lower turn table, the upper turn table, the sun gear, and the internal gear, with a cooling fluid supplying hose and cooling the speed reducers, and the cooling fluid supplying means be placed in an area that is different from the area in which the lower turn table is included.

As described above, when the double-side polishing apparatus includes cooling fluid supplying means circulating and supplying a cooling fluid to the speed reducers, one for each of the lower turn table, the upper turn table, the sun gear, and the internal gear for driving the lower turn table, the upper turn table, the sun gear, and the internal gear, with a cooling fluid supplying hose and cooling the speed reducers, it is possible to remove heat generated from the speed reducers quickly. Furthermore, when the cooling fluid supplying means is placed in an area that is different from the area in which the lower turn table is included, it is also possible to exhaust heat generated from the cooling fluid supplying means quickly to the outside of the apparatus without affecting the lower turn table, making it possible to prevent a slight distortion of the lower turn table more effectively.

Furthermore, in the polishing apparatus of the invention, it is preferable that the partition wall be a steel sheet on which a urethane foam sheet is laid.

As described above, when the partition wall is a steel sheet on which a urethane foam sheet is laid, it is possible to obtain a partition wall having strength and excellent thermal insulation properties, making it possible to prevent heat from moving between the areas separated by the partition wall more effectively.

With the polishing apparatus according to the invention, it is possible to prevent heat generated from a heat-generating source from directly affecting the lower turn table, and exhaust heat quickly to the outside of the apparatus, making it possible to prevent effectively a slight distortion in the shape of the lower turn table caused by the influence of heat, in particular, a change in the shape of the lower turn table caused by a change in thermal environment with the time that has elapsed since the operation of the polishing apparatus was started. As a result, it is possible to polish the wafer in a stable shape regardless of the time that has elapsed since the operation of the polishing apparatus was started or the presence or absence of a stop.

BRIEF DESCRIPTION OF DRAWINGS

FIG. 1 is a sectional view schematically showing a principal portion of a first embodiment of a polishing apparatus according to the invention;

FIG. 2 is an apparatus diagram schematically showing a principal portion of the first embodiment of the polishing apparatus according to the invention, the principal portion seen through the apparatus from above;

FIG. 3 is a sectional view schematically showing a principal portion of a second embodiment of the polishing apparatus according to the invention; and FIG. 4 is a sectional view schematically showing a principal portion of an example of a conventional double-side polishing apparatus.

BEST MODE FOR CARRYING OUT THE INVENTION

Hereinafter, the invention is explained in more detail.

As described above, the problem is that, in order to obtain a high degree of flatness of a wafer with stability by using a polishing apparatus, the temperature control by polishing slurry and the removal of heat of polishing generated by machining by supplying cooling water to a cooling jacket are not enough.

The inventors conducted a study and examination of this problem, and found that the temperature of the lower turn table 82 rose greatly due to the influence of heat generated from various motors, speed reducers, and the like, for driving the turn table and the like, and, in order to reduce the temperature rise caused by such a factor, the above-described temperature control by polishing slurry and the temperature control by supplying cooling water to a cooling jacket were not enough. The temperature increased by such a factor causes a slight change in the shape of the lower turn table 82, which also affects the shape of a wafer.

Then, the inventors studied measures to solve the above problem, and found out that separating the various motors and speed reducers for driving the turn table and the like, in particular, the motor driving the lower turn table which was the biggest heat-generating source, from the lower turn table with a partition wall provided between them made it possible to reduce heat transferred to the lower turn table greatly, stabilize the shape of the lower turn table during the operation of the apparatus, and obtain a wafer with a high degree of flatness with stability, and completed the invention.

Hereinafter, a polishing apparatus according to the invention is explained specifically with reference to the accompanying drawings; the invention, however, is not limited thereto. It should be understood that polishing in this description covers not only typical polishing but also such a concept as so-called grinding or lapping, and refers to processing by which the front surface of a wafer is gradually smoothed away for the purpose of machining the wafer to have a high degree of flatness.

FIG. 1 depicts a double-side polishing apparatus as an example (a first embodiment) of the polishing apparatus according to the invention.

A double-side polishing apparatus 11 mainly includes rotatable disk-shaped lower turn table 12 and upper turn table 13, a carrier plate 16 which is placed between the upper and lower turn tables 12 and 13, has a wafer holding hole 16*a* holding a wafer W, and performs planetary movement, and a sun gear 14 and an internal gear 15 which move the carrier plate 16. The lower turn table 12, the upper turn table 13, the sun gear 14, and the internal gear 15 are driven by their respective drive motors 18*a*, 18*b*, 18*c*, and 18*d* and speed reducers 19*a*, 19*b*, 19*c*, and 19*d* placed in an apparatus main body box 17. Incidentally, two or more components of the lower turn table 12, the upper turn table 13, the sun gear 14, and the internal gear 15 may be moved by using the same motor. Depending on the purpose of polishing, a polishing pad (not shown) is attached to the polishing surfaces of the upper and lower turn tables. Moreover, a cooling jacket 20 may be attached on a side of the turn table, the side opposite to the polishing surface. Furthermore, an upper cover 21 covering an upper part of the apparatus may be placed.

Then, in the double-side polishing apparatus 11 of the invention, partition walls 31*a* and 31*b* are provided in the box 17, and the inside of the box 17 is separated into a plurality of areas. Moreover, at least the motor 18*a* driving the lower turn table 12 is placed in an area that is different from an area in which the lower turn table 12 is included. Furthermore, the speed reducer 19*a* driving the lower turn table and the motors 18*b*, 18*c*, and 18*d* and the speed reducers 19*b*, 19*c*, and 19*d* driving the upper turn table 13, the sun gear 14, and the internal gear 15, respectively, may be placed in an area that is different from the area in which the lower turn table 12 is included. Incidentally, as for the motors and the speed reducers, two or more components may be placed in the same area, or may be placed in different areas. In FIG. 1, an example in which an area is separated by the partition walls 31*a* and 31*b* into three areas, an area (a first area) in which the motor 18*a* driving the lower turn table 12 is placed, an area (a second area) in which the speed reducer 19*a* driving the lower turn table and the motors 18*b*, 18*c*, and 18*d* and the speed reducers 19*b*, 19*c*, and 19*d* driving the upper turn table 13, the sun gear 14, and the internal gear 15, respectively, are placed, and an area (a third area) in which the lower turn table 12 is included is shown; however, it is not limited thereto.

Moreover, in general, in the box of the double-side polishing apparatus, as a means of circulating the air inside the box, an exhaust duct, an outside air intake, and the like, are placed. In the double-side polishing apparatus 11 according to the invention, the inside of the box 17 is separated into a plurality of areas, and it is preferable that the areas be provided individually with the air circulating means. In FIG. 1, an embodiment in which the first area is provided with an outside air intake 23*a* and an exhaust duct 22*a*, the second area is provided with an outside air intake 23*b*, a blast fan 24*b*, and an exhaust duct 22*b*, and the third area is provided with an outside air intake 23*c*, a blast fan 24*c*, and an exhaust duct 22*c* is shown as an example. Incidentally, the outside air intake simply has to be an opening that can take the outside air in each area, and it does not necessarily have to be specially provided in each area. For example, as 23*a* of FIG. 1, it may be a clearance between the upper cover 21 and the box 17. Moreover, for an area communicating with the inside of the upper cover 21 (in the case of FIG. 1, the above-described third area communicates with the area inside the upper cover 21 via a clearance between the box 17 and the internal gear 15), as 23*c* of FIG. 1, the air may be made to circulate in the area by providing an outside air intake in the upper cover 21. Furthermore, when the areas have exhaust outlets individually, the exhaust ducts 22*a*, 22*b*, and 22*c* may be joined together such that the air is exhausted through a collecting duct 25.

When double-side polishing of the wafer W is performed by using the double-side polishing apparatus 11 having the above-described structure, the wafer W is held in the wafer holding hole 16*a* of the carrier plate 16, the wafer W is held between the upper and lower turn tables 12 and 13, and polishing is performed while applying pressure from the side of the upper turn table 13, rotating the wafer W and the upper and lower turn tables 12 and 13, and supplying polishing slurry to the machining surfaces thereof from unillustrated polishing slurry supplying means. In the double-side polishing apparatus 11 of the invention, since the motor 18*a* driving the lower turn table 12 is placed in the area that is different from the area in which the lower turn table 12 is included, when polishing is performed, it is possible to exhaust heat generated from the motor 18*a* driving the lower turn table 12 quickly to the outside of the double-side polishing apparatus 11 without affecting the lower turn table, making it possible to prevent effectively a slight distortion in the shape of the lower turn table 12 caused by the influence of heat, in particular, a change in the shape of the lower turn table 12 caused by a change in thermal environment with the time that has elapsed since the operation of the polishing apparatus was started. As a result, it is possible to polish the wafer W in a stable shape. In particular, it is possible to polish the wafer W in a stable shape regardless of the time that has elapsed since the operation of the polishing apparatus was started or the presence or absence of a stop.

Moreover, as described above, when the speed reducer 19*a* driving the lower turn table and the motor 18*b*, 18*c*, and 18*d* and the speed reducers 19*b*, 19*c*, and 19*d* driving the upper turn table 13, the sun gear 14, and the internal gear 15, respectively, are placed in an area that is different from the area in which the lower turn table 12 is included, it is possible to exhaust heat generated from them to the outside of the double-side polishing apparatus 11 in a similar manner without affecting the lower turn table.

In addition, as described above, when the areas in the box, the areas separated by the partition wall, are individually provided with the air circulating means, such as an exhaust duct, an outside air intake, a blast fan (or a blower), and the like, it is possible to circulate the air in the areas separated by the partition wall on an individual basis and perform individual temperature management in the areas, making it possible to exhaust heat generated from the above-described heat-generating sources more efficiently to the outside of the apparatus.

Furthermore, FIG. 2 is an apparatus diagram schematically showing a principal portion of the double-side polishing apparatus 11 according to the invention, the principal portion seen through the apparatus from above. As shown in FIG. 2, it is preferable that the apparatus be provided with cooling fluid supplying means 42 which circulates and supplies a cooling fluid to the speed reducers 19*a*, 19*b*, 19*c*, and 19*d* driving the lower turn table 12, the upper turn table 13, the sun gear 14, and the internal gear 15 (see FIG. 1 for them), respectively, with a cooling fluid supplying hose 43, and thereby cools the speed reducers. As described above, by removing heat quickly from the speed reducers by the cooling fluid supplying means 42, it is possible to exhaust generated heat more efficiently.

However, since the cooling fluid supplying means 42 serves as a heat-generating source because it generally includes a motor, a pump, and the like, inside it, it is preferable that the cooling fluid supplying means 42 be placed in an area that is different from the area in which the lower turn table 12 is included for reasons similar to those for the above-described heat-generating sources.

Incidentally, although a material of the partition walls 31*a* and 31*b* is not particularly limited, a steel sheet on which a urethane sheet is laid is preferable because it makes it possible to obtain a partition wall having both strength and high thermal insulation properties by using an inexpensive material, and prevent heat from moving between the separated areas more effectively.

FIG. 3 depicts a single-side polishing apparatus as another example (a second embodiment) of the polishing apparatus according to the invention.

A single-side polishing apparatus 61 mainly includes a rotatable disk-shaped lower turn table 12 and a rotatable polishing head 63, which holds a wafer W. The lower turn table 12 is driven by a drive motor 18*a* and a speed reducer 19*a* placed in an apparatus main body box 17. Incidentally, depending on the purpose of polishing, a polishing pad (not shown) is attached to the polishing surface of the lower turn table 12. Moreover, a cooling jacket 20 may be attached on a side of the lower turn table 12, the side opposite to the polishing surface. Furthermore, an upper cover 21 covering an upper part of the apparatus may be placed.

Then, in the single-side polishing apparatus 61 of the invention, a partition wall is provided, the box 17 is separated into a plurality of areas, and at least the motor 18*a* driving the lower turn table 12 is placed in an area that is different from an area in which the lower turn table 12 is included. In FIG. 3, an example in which an area is separated by a partition wall 31*a* into two areas, an area (a first area) in which the motor 18*a* driving the lower turn table 12 is placed and an area (a second area) in which the speed reducer 19*a* driving the lower turn table is placed and the lower turn table 12 is included is shown; however, it is not limited thereto. Another partition wall may be provided such that the speed reducer 19*a* driving the lower turn table is placed in an area that is different from the area in which the lower turn table 12 is included.

In addition to the above, as is the case with the double-side polishing apparatus described above, a means of circulating air may be individually placed in the areas separated by the partition wall. In FIG. 3, an embodiment in which the first area is provided with an outside air intake 23*a* and an exhaust duct 22*a* and the second area is provided with an outside air intake 23*b*, a blast fan 24*b*, and an exhaust duct 22*b* is shown as an example. Moreover, the outside air intake simply has to be an opening that can take the outside air in each area. Furthermore, the exhaust ducts may be joined together such that the air of the entire area is exhausted through a collecting duct 25. In addition, cooling fluid supplying means supplying a cooling fluid to the speed reducer 19*a* with a cooling fluid supplying hose may be provided, and, in this case, it is preferable that the cooling fluid supplying means be placed in an area that is different from that of the lower turn table 12.

When single-side polishing of the wafer W is performed by using the single-side polishing apparatus 61 having the above-described structure, the wafer W is held on the polishing head 63 by various known holding methods such as attaching it with wax or vacuum sucking, and polishing is performed while applying pressure from the side of the polishing head 63, rotating the wafer W, the polishing head 63, and the lower turn table 12, and supplying polishing slurry to the machining surface thereof. In the single-side polishing apparatus 61 of the invention, since the motor 18*a* driving the lower turn table 12 is placed in an area that is different from the area in which the lower turn table 12 is included, as is the case with the double-side polishing apparatus described above, when polishing is performed, it is possible to exhaust heat generated from the motor 18*a* driving the lower turn table 12 quickly to the outside of the single-side polishing apparatus 61 without affecting the lower turn table, making it possible to prevent effectively a slight distortion in the shape of the lower turn table 12 caused by the influence of heat. As a result, it is possible to polish the wafer W in a stable shape.

Hereinafter, examples and comparative examples of the invention are explained.

EXAMPLE 1

The lower turn table 12, the upper turn table 13, the sun gear 14, and the internal gear 15 were rotated under no load condition for three hours (without setting a wafer W and performing actual polishing of the wafer) by using the double-side polishing apparatus 11 of the invention having the structure shown in FIG. 1, and the shape of the front surface of the lower turn table 12 before and after operation of the apparatus was measured, whereby the measurement of the deformation of the lower turn table 12 caused by heat generated from the motors and the speed reducers was carried out. Incidentally, the lower turn table 12 and the upper turn table 13 both had an outside diameter of 1420 mm and an inside diameter of 430 mm, and the operating conditions were set as follows: the rotation speed of the lower turn table was 50 rpm, the rotation speed of the upper turn table was 30 rpm in a direction opposite to that of the lower turn table, the rotation speed of the sun gear was 35 rpm, and the rotation speed of the internal gear was 3 rpm.

Incidentally, the measurement of the deformation of the lower turn table was carried out using a stylus type profilometer.

According to the results, the shape of the lower turn table when the apparatus was at a standstill had a dimple of 1 μm (a difference between the outer edge of the lower turn table and the lowest point near the center thereof was 1 μm), and the shape thereof after the apparatus had been operated for three hours had a dimple of 2.6 μm.

COMPARATIVE EXAMPLE 1

Operation was performed under no load condition as in Example 1 by using the conventional double-side polishing apparatus 81 shown in FIG. 4, and a change in the shape of the front surface of the lower turn table was measured.

According to the results, while the shape of the lower turn table when the apparatus was at a standstill had a dimple of 1 μm, the shape thereof after the apparatus had been operated for three hours had a dimple of 11 μm, and there was a change of 10 μm. Moreover, a measurement carried out one hour after operation of the apparatus was stopped revealed that the dimple was 3 μm, and there was a tendency to return to the shape observed when the apparatus was in a stopped state.

As described above, while the amount of change in the shape of the lower turn table caused by operation of the apparatus was 10 μm in the conventional apparatus, it was 1.6 μm in the apparatus of the invention, and the results revealed the stability of the shape of the lower turn table according to the invention.

EXAMPLE 2

By using the double-side polishing apparatus 11 of the invention shown in FIG. 1, double-side polishing was actually performed on a silicon single crystal wafer subjected to lapping. Incidentally, the lower turn table 12 and the upper turn table 13 both had an outside diameter of 1420 mm and an inside diameter of 430 mm. Five silicon single crystal wafers having a diameter of 300 mm were polished in one batch by using five carrier plates 16 per batch, the carrier plates 16 each having one wafer holding hole 16*a*. A normal polishing pad and a normal polishing slurry were used. The polishing conditions were set as follows: a polishing load was 100 g/cm$^2$, the rotation speed of the lower turn table was 50 rpm, the rotation speed of the upper turn table was 30 rpm in a direction opposite to that of the lower turn table, the rotation speed of the sun gear was 35 rpm, the rotation speed of the internal gear was 3 rpm, and a polishing time in one batch was 30 minutes.

Polishing was performed from a state in which the apparatus had been in a stopped state for 12 hours or more, and changes in the shape of the wafer observed with the progress of a polishing batch were compared.

According to the results, the shape was flat continuously from the first batch to the fifth batch, and GBIR (global backside ideal range, which is a difference between a maximum positional displacement and a minimum positional displacement relative to one reference surface which is present in the plane of a wafer in a state in which the back surface of the wafer is corrected to be a flat surface, and serves as an indicator of the flatness of the wafer) was 0.1 μm.

It is considered that, since, in the double-side polishing apparatus 11 of the invention, the lower turn table motor 18*a* serving as an intense heat-generating source is isolated, by the partition wall 31*a*, from the area in which the lower turn table 12 is included, a change in the shape of the lower turn table 12 caused by the influence of heat was reduced, whereby the flatness of the wafer was obtained with stability.

COMPARATIVE EXAMPLE 2

Double-side polishing of a wafer W was actually performed under the same conditions as those of Example 2 except that the conventional double-side polishing apparatus 81 shown in FIG. 4 was used. Incidentally, the carrier plates identical to those used, in Example 2 were used.

According to the results, in the first batch, the shape was convex and GBIR was 1 μm, in the second batch, the shape was convex and GBIR was 0.2 μm, in the third batch, the shape was concave and GBIR was 0.2 μm, in the fourth batch, the shape was concave and GBIR was 0.4 μm, and, in the fifth batch, the shape was concave and GBIR was 0.5 μm.

It is considered that, in the conventional double-side polishing apparatus 81, due to the influence of heat generated from the lower turn table motor 18*a* and the like, the shape of the lower turn table 82 changed slightly, resulting in unstable flatness of the wafer.

It is to be understood that the present invention is not limited in any way by the embodiment thereof described above. The above embodiment is merely an example, and anything that has substantially the same structure as the technical idea recited in the claims of the present invention and that offers similar workings and benefits falls within the technical scope of the present invention.

The invention claimed is:

1. A polishing apparatus comprising at least: a lower turn table; a motor and a speed reducer for driving the lower turn table; and a box covering at least a portion below a machining surface of the lower turn table, the polishing apparatus pressing a wafer against the lower turn table and polishing the wafer by rotating the lower turn table, wherein:

an inside of the box is separated into a plurality of areas by a partition wall, and the motor driving the lower turn table is placed in an area that is different from the area in which the lower turn table is included, and the plurality of areas separated by the partition wall each include air circulating means.

2. The polishing apparatus according to claim 1, wherein, in the box, the speed reducer driving the lower turn table is placed in an area that is different from the area in which the lower turn table is included.

3. The polishing apparatus according to claim 1, wherein the polishing apparatus comprises cooling fluid supplying means circulating and supplying a cooling fluid to at least the speed reducer driving the lower turn table with a cooling fluid supplying hose and cooling the speed reducer, and the cooling fluid supplying means is placed in an area that is different from the area in which the lower turn table is included.

4. The polishing apparatus according to claim 1, wherein the polishing apparatus comprises a polishing head holding the wafer, and the polishing apparatus presses the wafer against the lower turn table with the polishing head, and polishes the wafer.

5. The polishing apparatus according to claim 1, wherein the polishing apparatus further comprises an upper turn table, a sun gear, an internal gear, motors and speed reducers, one for each of the upper turn table, the sun gear, and the internal gear for driving the upper turn table, the sun gear, and the internal gear, and a plurality of carrier plates each having a wafer holding hole holding the wafer, and the polishing apparatus is a double-side polishing apparatus which holds the wafer in the wafer holding hole of the carrier plate, holds the wafer between the lower turn table and the upper turn table, and performs double-side polishing on the wafer by rotating the lower turn table and the upper turn table while making the carrier plate rotate on an axis thereof and revolve around a point by rotating the sun gear and the internal gear.

6. The polishing apparatus according to claim 5, wherein the motors and speed reducers, one for each of the upper turn table, the sun gear, and the internal gear for driving the upper turn table, the sun gear, and the internal gear, are placed in an area that is different from the area in which the lower turn table is included.

7. The polishing apparatus according to claim 5, wherein the polishing apparatus comprises cooling fluid supplying means circulating and supplying a cooling fluid to the speed reducers, one for each of the lower turn table, the upper turn table, the sun gear, and the internal gear for driving the lower turn table, the upper turn table, the sun gear, and the internal gear, with a cooling fluid supplying hose and cooling the speed reducers, and the cooling fluid supplying means is placed in an area that is different from the area in which the lower turn table is included.

8. The polishing apparatus according to claim 1, wherein the partition wall is a steel sheet on which a urethane foam sheet is laid.

9. The polishing apparatus according to claim 2, wherein the polishing apparatus comprises cooling fluid supplying means circulating and supplying a cooling fluid to at least the speed reducer driving the lower turn table with a cooling fluid supplying hose and cooling the speed reducer, and the cooling fluid supplying means is placed in an area that is different from the area in which the lower turn table is included.

10. The polishing apparatus according to claim 2, wherein the polishing apparatus comprises a polishing head holding the wafer, and the polishing apparatus presses the wafer against the lower turn table with the polishing head, and polishes the wafer.

11. The polishing apparatus according to claim 2, wherein the polishing apparatus further comprises an upper turn table, a sun gear, an internal gear, motors and speed reducers, one for each of the upper turn table, the sun gear, and the internal gear for driving the upper turn table, the sun gear, and the internal gear, and a plurality of carrier plates each having a wafer holding hole holding the wafer, and the polishing apparatus is a double-side polishing apparatus which holds the wafer in the wafer holding hole of the carrier plate, holds the wafer between the lower turn table and the upper turn table, and performs double-side polishing on the wafer by rotating the lower turn table and the upper turn table while making the carrier plate rotate on an axis thereof and revolve around a point by rotating the sun gear and the internal gear.

* * * * *